United States Patent [19]

Cupp

[11] Patent Number: 4,956,932

[45] Date of Patent: Sep. 18, 1990

[54] GUN RECOIL PAD

[75] Inventor: Carl J. Cupp, Hawaiian Gardens, Calif.

[73] Assignee: Pachmayr Ltd., Monrovia, Calif.

[21] Appl. No.: 422,084

[22] Filed: Oct. 16, 1989

[51] Int. Cl.[5] ..... F41C 23/08

[52] U.S. Cl. ..... 42/74

[58] Field of Search ..... 42/71.01, 74

[56] References Cited

U.S. PATENT DOCUMENTS

| | | |
|---|---|---|
| 2,650,446 | 9/1953 | Bivens . |
| 3,007,272 | 11/1961 | Pachmayr . |
| 3,135,064 | 6/1964 | Pachmayr . |
| 3,147,562 | 9/1964 | Pachmayr et al. . |
| 3,160,976 | 12/1964 | Pachmayr . |
| 3,263,359 | 8/1966 | Pachmayr . |
| 3,274,725 | 9/1966 | Pachmayr . |
| 3,363,352 | 1/1968 | Pachmayr . |
| 3,514,889 | 6/1970 | Pachmayr . |
| 3,609,903 | 10/1971 | Pachmayr et al. . |
| 3,683,538 | 8/1972 | Locatelli . |

OTHER PUBLICATIONS

Exhibits A, B and C show a recoil pad sold by Pachmayr Ltd.

Exhibits D, E and F show a recoil pad which is marketed in Europe.

*Primary Examiner*—Charles T. Jordan
*Assistant Examiner*—Richard W. Wendtland
*Attorney, Agent, or Firm*—William P. Green

[57] ABSTRACT

A recoil pad for a shoulder gun such as a rifle or shotgun, including a body of elastomeric cushioning material to be received between the buttstock of the gun and a user'shoulder, and an insert member formed of a material harder than the elastomeric material and embedded within a recess in the back of the elastomeric body near its upper end. The pad may also include an attachment plate secured to the front of the elastomeric body. The insert member has a rear surface which engages the user's clothing at a location above an aligned rear surface of the elastomeric body, to reduce the friction at the location of the insert and facilitate sliding of the recoil pad upwardly adjacent the clothing to firing position. The elastomeric body has a portion extending upwardly in front of the harder insert to be received between that insert and the buttstock of the gun and cushion the transmission of recoil forces from the gun to the insert.

10 Claims, 2 Drawing Sheets

GUN RECOIL PAD

This invention relates to recoil pads for a shoulder gun such as a rifle or shotgun.

Background of the Invention

The recoil forces exerted by a rifle or shotgun upon firing can be cushioned by attaching to the buttstock of the gun a recoil pad formed of an elastomeric material such as rubber and acting by resilient deformation to absorb at least some of those forces without transmission to the user's shoulder. Various types of recoil pads have been devised in the past for this purpose. In some instances, the pad has included a forward layer or plate of a relatively hard and stiff material containing openings through which screws can extend for attaching the pad to a gun. The main body of elastomeric material may be bonded to the rear surface of this attachment layer, and may contain recesses for enhancing deformation of the elastomeric body and increasing its recoil absorbing capacity.

In a shooting match or exhibition, the presence of a recoil pad on the gun may slightly increase the time required for raising the gun to firing position because the rubber of the pad does not slide easily upwardly while in contact with the user's clothing. In an attempt to overcome this problem, some shooters have covered pads with plastic tape, to reduce the frictional resistance to movement of the gun to firing position. However, this expedient is only a very temporary and partial solution to the problem, and may reduce the friction so much that the gun can slip relative to the shoulder during aiming or firing.

Summary of the Invention

A major purpose of the present invention is to provide an improved recoil pad which will be very easily slidable upwardly to firing position but will then have sufficient friction to assist in retaining the gun against shifting movement during firing, and which in addition will have an effective cushioning effect over the entire cross sectional area of the pad from its lower end to its upper end. These results are achieved by providing a pad including a body of elastomeric material, and a rear insert of harder material embedded within a recess formed in the back of the elastomeric body near its upper end. The insert has a rear surface which engages the user's clothing at a location above the rear surface of a lower portion of the elastomeric body, and which has less friction than the elastomeric material with respect to the user's clothing, to facilitate sliding of the recoil pad upwardly adjacent the clothing to firing position. The higher friction surface of the elastomeric material beneath the upper member engages the user's clothing when in firing position to prevent shifting of the pad relative to the shoulder as the gun is aimed and fired. The elastomeric body has an upper portion which extends upwardly in front of the harder low friction insert, to be received between that insert and the buttstock of the gun and thereby cushion the transmission of recoil forces from the gun to the insert. Thus, a cushioning effect is attained at all locations, even at the location of the insert.

Brief Description of the Drawings

The above and other features and objects of the invention will be better understood from the following detailed description of the typical embodiment illustrated in the accompanying drawings, in which.

Description of the Preferred Embodiment

Figure 1:
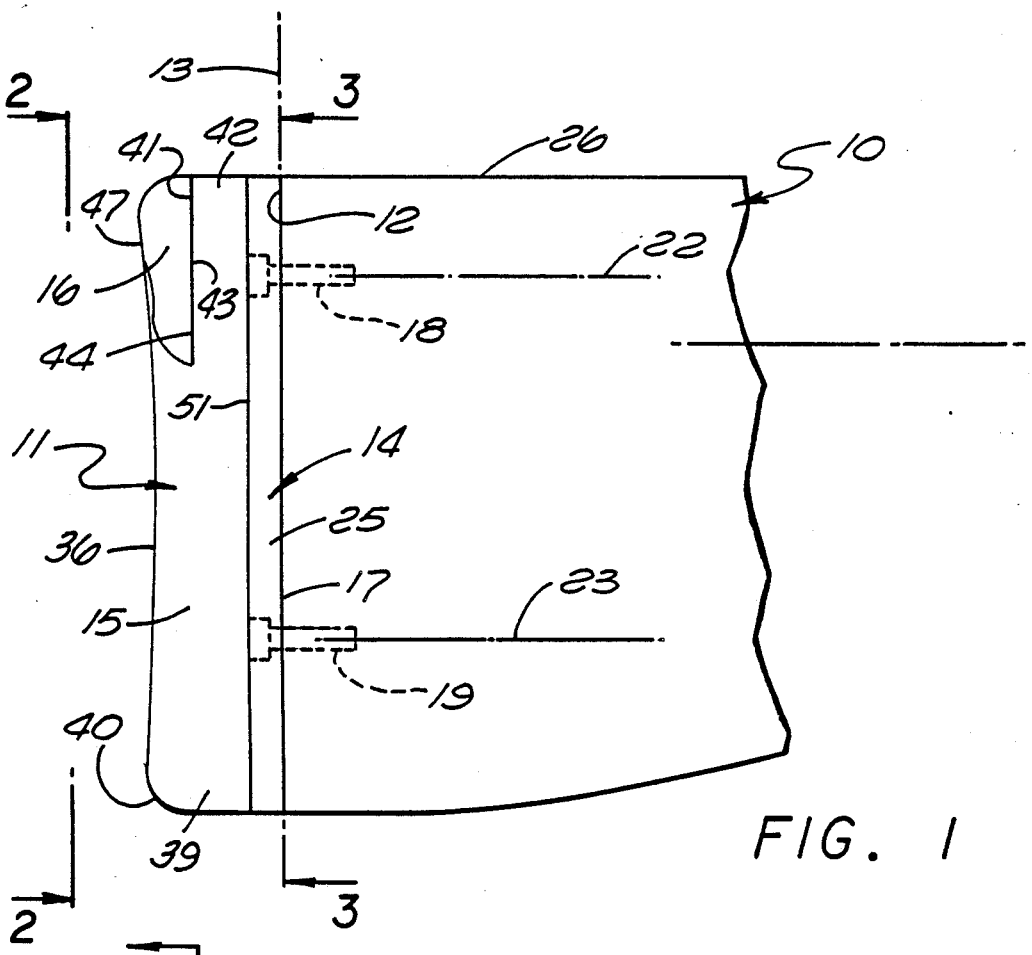
FIG. 1 is a side elevational view of a recoil pad constructed in accordance with the invention, shown attached to the buttstock of a shoulder gun, such as a shotgun or a rifle.

In FIG. 1, there is represented fragmentarily at 10 the rear buttstock portion of a shotgun, rifle or other shoulder gun, to which there is attached a recoil pad 11 embodying the present invention. The buttstock 10 of the gun has a rear surface 12 which may be planar and disposed essentially perpendicular to the axis 24 of the barrel of the gun, and which lies in a vertical plane 13 in the FIG. 1 position of the gun.

The recoil pad 11 includes a front plate or lamination 14, an elastomeric body 15 of the pad which is resiliently deformable to absorb recoil forces, and an upper rear insert member 16. This member 16 is formed of a material which is substantially harder than that of elastomeric body 15, and which has less friction with respect to a user's clothing than does the material of body 15. Stated differently, the coefficient of friction between member 16 and any conventional clothing material such as cotton or wool fabric, nylon or other resinous plastic material, leather, or the like is less than the coefficient between the elastomeric material of body 15 and the same clothing material. The forward plate 14 is also preferably substantially harder than the elastomeric material of body 15. For best results, both of the members 16 and 14 are essentially rigid.

In the presently preferred arrangement, body 15 is molded of neoprene rubber having a Shore hardness between about 20 and 45 (desirably about 25) on the A scale. The other two components of the pad, that is, members 1.4 and 16, are preferably formed of neoprene rubber having a shore hardness between about 60 and 85 (for best results about 70) on the D scale.

The two hard members 14 and 16 may be first molded separately to the configurations shown in the drawings and discussed below, and may then be placed in proper orientation within a final mold in which the main body 15 of softer rubber is molded and cured. This molding process forms a tight continuous bond between body 15 and the engaging surfaces of the other parts, resulting in a permanently integrated recoil pad structure including the three components.

Figure 2:
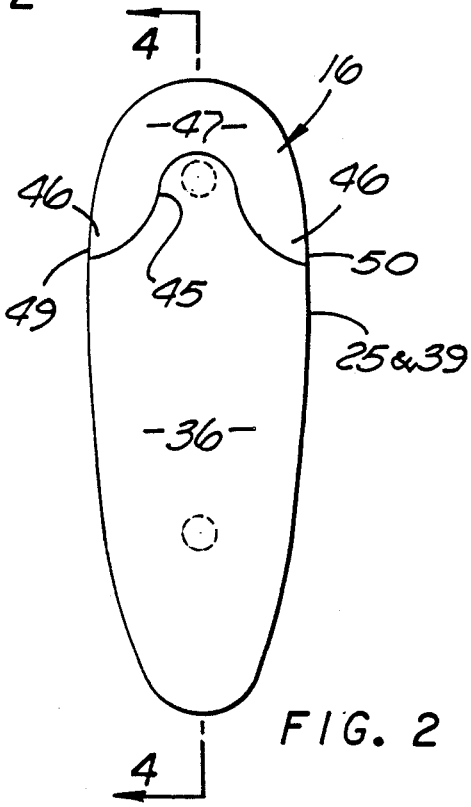
FIG. 2 is a rear elevational view taken on line 2—2 of FIG. 1.
Figure 3:
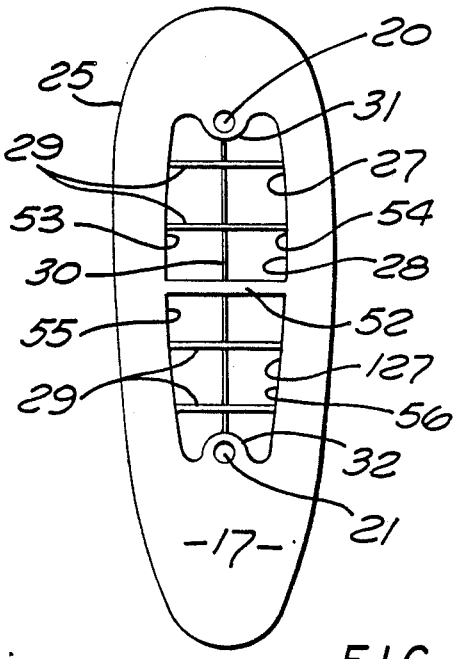
FIG. 3 is a front view of the recoil pad, taken on line 3—3 of FIG. 1.

Front plate 14 has a forward planar surface 17 which engages the rear surface 12 of the gun stock and is held tightly thereagainst by two screws 18 and 19 extending through openings 20 and 21 in plate 14 and connecting into the wood of the gun stock. These screws are centered about axes 22 and 23 which are parallel to the main axis 24 of the barrel of the gun and are perpendicular to planar surfaces 12 and 17. The rear surface 51 of plate 14 may also be planar and disposed parallel to the front surface 17. The peripheral edge surface 25 of plate 14 is shaped to follow the contour of the external surface 26 of the gun stock, and to form in effect a rearward continuation thereof. The outline configuration of surface 25 may be as illustrated in FIG. 2. As seen in FIG. 3, plate 14 contains two upper and lower openings 27 and 127 separated by a narrow horizontal cross piece portion 52 of plate 14 and providing access through the plate to an internal recess 28 formed within elastomeric body 15. The upper opening 27 is defined by crosspiece 52, two edges 53 and 54 extending upwardly at opposite sides of the opening, and an edge 31 at the top of the projection shaped as shown in FIG. 3 to form a projection through which screw 18 extends. Similarly, the lower opening 127 is defined by cross piece 52, two side edges 55 and 56, and an edge 32 forming a projection through which screw 19 extends.

Figure 4:
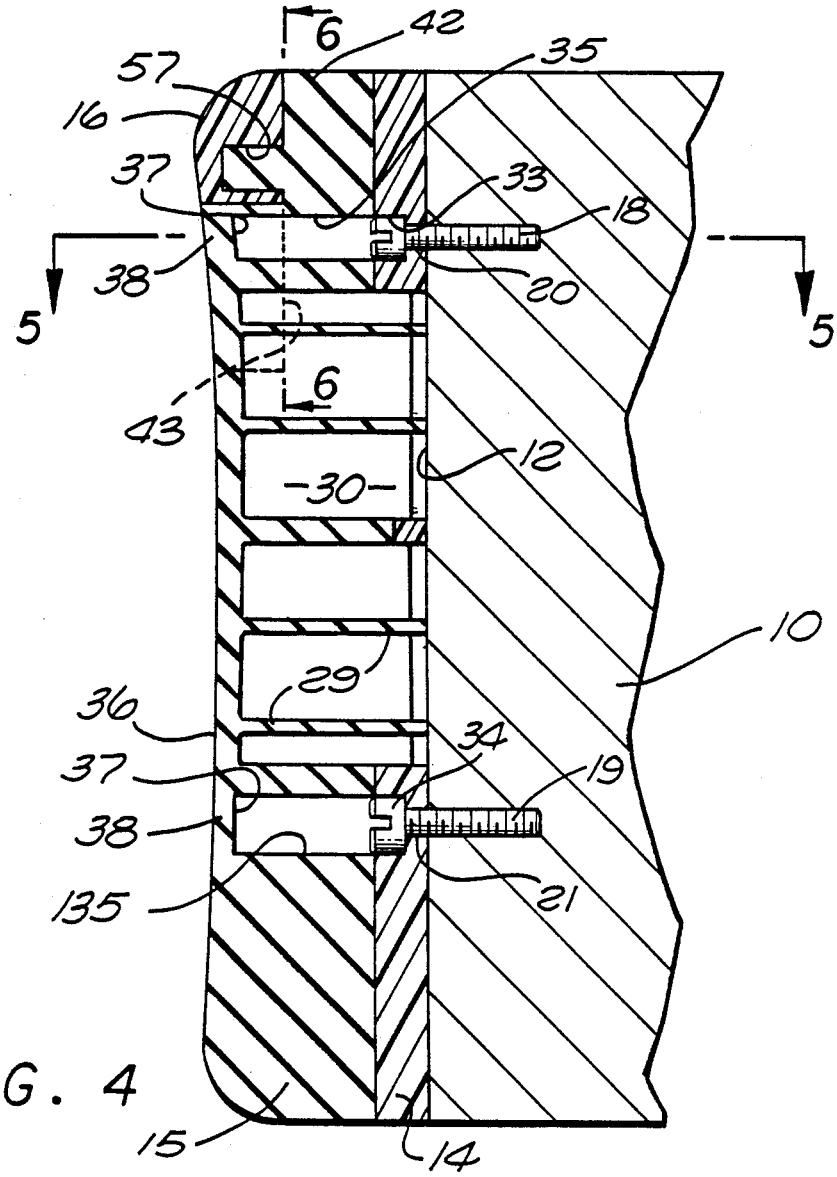
FIG. 4 is an enlarged central vertical section through the recoil pad taken, on line 4—4 of FIG. 2.
Figure 5:
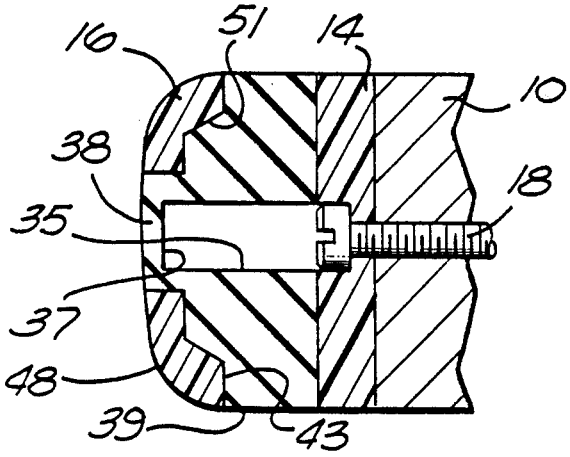
FIG. 5 is a horizontal section taken on line 5—5 of FIG. 4.

Recess 28 within the interior of body 15 is elongated vertically in a pattern corresponding to the shape of openings 27 and 127 together. This recess increases the resilient deformability of body 15 when subjected to recoil forces upon firing of the gun, and thereby enhances the capacity of the pad to absorb those forces. Compression of the air within recess 28 offers some yielding resistance to deformation of the elastomeric material. Within recess 28, the material of body 15 may be shaped during the molding process to form a number of parallel horizontal partitions 29 and a central vertical partition 30 dividing the interior of recess 28 into a number of compartments 129 within which the air is trapped. The forward edges of partitions 29 and 30 may engage rear surface 12 of the gun stock to isolate the air within each of the compartments 129 from communication with the air in the other compartments, so that the air in each compartment is separately compressible and the resistance to compression offered by the air is distributed effectively over the entire cross section of recess 28. Alternatively, the forward edge or edges of one or more of the partitions 29 or 30 may be spaced a short distance from surface 12 of the gun stock. For example, the vertical partition 30 may be spaced slightly from surface 12 while partitions 29 are in contact therewith. At the left side of plate 14 as seen in FIG. 4, this plate may contain shallow circular recesses 33 for receiving the enlarged heads 34 of screws 18 and 19.

Directly rearwardly of the screw passing openings 20 and 21 in plate 14, the elastomeric material of body 15 contains two cylindrical passages 35 and 135 centered about the parallel axes 22 and 23 of the screws to allow insertion of the screws forwardly through those passages and then through openings 20 and 21 for connection to the buttstock of the gun. These passages 34 and 35 preferably terminate leftwardly at the locations 37 of FIG. 4, to leave thin layers 38 of the elastomeric material of body 15 initially closing the left ends of passages 35 and 135, so that the rear surface 36 of body 15 is continuous and uninterrupted at the location of passages 35 and 135. When the pad 11 is being attached to the gun, a user cuts a small slit or opening in each of the thin end walls 38 of the screw receiving passages, so that the screws and a screwdriver can be inserted through these slits or openings and into passages 35 and 135 to tighten the screws to their FIG. 4 positions, after which the screwdriver may be withdrawn to permit resilient return of the two end walls 38 to their original condition substantially closing the slits or openings and allowing the rear surface of the installed pad to be essentially continuous and uninterrupted.

The rear surface 36 of rubber body 15 is generally flat and generally perpendicular to the main front to rear axis 24 of the gun, but may be contoured slightly as illustrated in FIG. 1 in conventional manner to fit a user's shoulder. The side edge surface 39 of body 15 follows the same outline configuration as edge surface 25 of plate 14 and as the outer surface of the gun stock, to form a rearward continuation of these surfaces. As the side edge surface 39 of body 15 advances rearwardly, toward the location of surface 36, surface 39 curves gradually to a rounded configuration as illustrated at 40, ultimately merging with surface 36. This rounded edge configuration is provided at the bottom of body 15 and continuously upwardly along its opposite sides to the location of member 16.

The upper hard member 16 is embedded within a recess 41 formed in the back of body 15 at its upper end. Member 16 is spaced rearwardly from front plate 14, with the softer more deformable material of body 15 having a portion 42 projecting upwardly between members 16 and 14 as seen in FIG. 1, to provide a cushioning effect between these members. Member 16 has a forward surface 43 which may be planar and disposed parallel to surfaces 17 and 51 of plate 14, and which is bonded tightly to a correspondingly planar rear surface 44 of the elastomeric material of body 15. As seen from the rear (FIG. 2), member 14 preferably has an inverted U-shaped configuration, defining a bottom recess 45 into which the elastomeric material of body 15 extends upwardly at the location of upper screw receiving passage 35. At the opposite sides of this recess 45 and the screw receiving passage, member 16 has side portions 46 which extend downwardly as seen in FIG. 2 along the opposite side edges of the pad. The rear surface 47 of member 16 is shaped to be aligned with surface 36 at the rear of body 15, and to form a smooth continuation of surface 36. Also, this rear surface 47 of member 16 is rounded as illustrated at 48, to merge with and form a continuation of the side surface 39 of elastomeric body 15. The outer edge of member 16 has this rounded configuration, corresponding essentially to the rounded edge 40 of body 15, along the entire outer edge of member 16, that is, from the location 49 of FIG. 2 upwardly along the left side of member 16 and then across its top and back down at the opposite side to the point 50. Thus, the composite pad has a uniformly rounded edge entirely about its periphery, and presents an essentially continuous rear surface at the locations of both of the parts 15 and 16. The rear surface 47 of member 16 is, however, harder than the rear surface 36 of body 15, and can engage a user's clothing with less friction than can surface 36.

Figure 6:
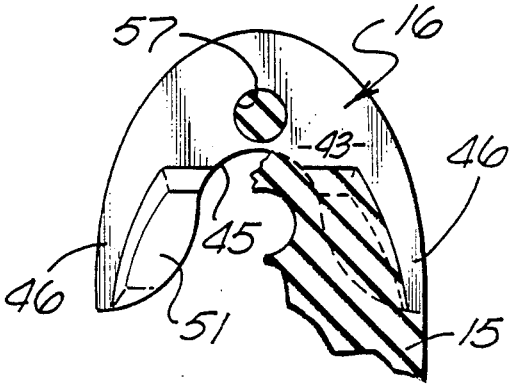
FIG. 6 is a front view of the upper hard insert, taken primarily on line 6—6 of FIG. 4, and with the elastomeric body of the pad partially broken away.

At the forward sides of the tWo downwardly projecting portions 46 of member 16, these portions 46 may contain recesses 51, spaced inwardly from the peripheral edge of member 16, to allow reception of some of the elastomeric material of member 15 in these recesses at the time that body 15 is molded, and therefore enhance the mechanical interconnection between members 15 and 16. FIGS. 4 and 6 illustrate an additional small cylindrical recess 57 in the upper portion of the forward surface of member 16, which may be formed during the initial molding of member 16, and into which the elastomeric material of body 15 may extend to further enhance the connection between members 15 and 16.

In preparing to fire a gun provided with the recoil pad 11 of the present invention, as a user moves the gun rapidly upwardly to firing position, the relatively low frictional characteristics of the exposed rear and peripheral surfaces of member 16 allow the gun to slide upwardly adjacent the user's jacket or other clothing and to the shoulder position with minimum frictional resistance. The gun can thus be moved into firing position more rapidly and easily than if the pad were formed entirely of the soft rubbery high friction material from which the resilient portion of the present pad is formed. After the present pad reaches firing position, the rear and peripheral surfaces of the soft rubber body 15 are in contact with the user's clothing at the shoulder location, and these surfaces then afford sufficient friction with respect to the clothing to assure retention of the gun against unwanted slipping from its firing position. When the gun is fired, the portion 42 of deformable body 15 between the harder member 16 and the upper portion of hard plate 14 absorbs recoil forces at the upper location, and the remainder of body 15 absorbs the recoil forces at other locations.

While a certain specific embodiment of the present invention has been disclosed as typical, the invention is of course not limited to this particular form, but rather is applicable broadly to all such variations as fall within the scope of the appended claims.

I CLAIM:

1. A recoil pad to be attached to a shoulder gun, comprising:

a forward plate containing upper and lower openings and adapted to be secured to the buttstock of the gun by upper and lower screws extending through said openings respectively and into the buttstock;

a body of elastomeric material which is secured to the back of said forward plate and which is softer than said forward plate and resiliently deformable to absorb recoil forces;

said elastomeric body containing upper and lower passages rearwardly opposite said upper and lower openings respectively in said forward plate to receive a tool for connecting said screws to the buttstock;

a rear member which is formed of a material harder than said elastomeric body and which is embedded in the back of said elastomeric body at the upper end thereof;

said rear member having two side portions extending downwardly in spaced relation at opposite sides of said upper passage in the elastomeric body and defining between said side portions a bottom recess in said member allowing access through said upper passage to said upper screw;

said elastomeric body having a lower portion with a rear surface formed of said resiliently deformable elastomeric material and adapted to engage a user's clothing in the shoulder area;

said rear member having a back surface formed of said harder material merging with and forming a smooth upper continuation of said rear surface of said lower portion of the elastomeric body for engaging the user's clothing thereabove, with less friction than the elastomeric material, to facilitate sliding of the recoil pad upwardly adjacent the clothing to firing position;

said body having an upper reduced thickness portion formed of said elastomeric material which extends upwardly in front of said rear member at a location between said member and an upper portion of said plate, and which is softer than said rear member and softer than said forward plate, and which is secured to and retains said rear member and is resiliently deformable to cushion the transmission of recoil forces from said forward plate to said rear member;

said rear member being free of attachment to said forward plate except through said elastomeric body;

said upper portion of the elastomeric body having a peripheral edge surface which is exposed between peripheral edges of said rear member and said forward plate continuously from a lower extremity of a first of said side portions of said member, at a first side of said bottom recess in said member, upwardly along said first side portion and across the top of said member and then downwardly along the second side portion of said member to a lower extremity thereof, at a second side of said bottom recess in said rear member.

2. A recoil pad as recited in claim 1, in which said rear member is essentially rigid.

3. A recoil pad as recited in claim 1, in which said rear member is adhesively bonded to said upper portion of said elastomeric material;

4. A recoil pad as recited in claim 1, in which said body of elastomeric material, including said lower and upper portions thereof, has a Shore hardness between about 20 and 45 on the A scale.

5. A recoil pad as recited in claim 1, in which said rear member has a Shore hardness between about 60 and 85 on the D scale.

6. A recoil pad as recited in claim 1, in which said body of elastomeric material, including said lower and upper portions thereof, has a Shore hardness between about 20 and 45 on the A scale, and said rear member has a Shore hardness between about 60 and 85 on the D scale.

7. A recoil pad as recited in claim 6, in which said rear member is adhesively bonded to said upper portion of said elastomeric material.

8. A recoil pad to be attached to a shoulder gun, comprising:

a forward plate containing upper and lower openings and adapted to be secured to the buttstock of the gun by upper and lower screws extending through said openings respectively and into the buttstock;

a body of elastomeric material which is secured to the back of said forward plate and which is softer than said forward plate and resiliently deformable to absorb recoil forces;

said elastomeric body containing upper and lower passages rearwardly opposite said upper and lower openings respectively in said forward plate to receive a tool for connecting said screws to the buttstock;

a rear member which is formed of a material harder than said elastomeric body and which is embedded in the back of said elastomeric body at the upper end thereof;

said rear member having two side portions extending downwardly in spaced relation along opposite sides of the pad and at opposite sides of said upper passage in the elastomeric body and to a level lower than said upper passage and said upper opening and said upper screw and defining between said side portions a bottom recess extending upwardly into a lower portion of said rear member to allow access through said bottom recess and through said upper passage in the elastomeric body to said upper screw;

said elastomeric body having a lower portion with a rear surface formed of said resiliently deformable elastomeric material and adapted to engage a user's clothing in the shoulder area;

said rear member having a back surface formed of said harder material merging with and forming a smooth upper continuation of said rear surface of said lower portion of the elastomeric body for engaging the user's clothing thereabove, with less friction than the elastomeric material, to facilitate sliding of the recoil pad upwardly adjacent the clothing to firing position;

said body having an upper reduced thickness portion formed of said elastomeric material which extends upwardly in front of said member at a location between said member and an upper portion of said plate, and which is softer than said rear member and softer than said forward plate, and which is secured to and retains said rear member and is resiliently deformable to cushion the transmission of recoil forces from said forward layer to said rear member;

said rear member being free of attachment to said forward plate except through said elastomeric body;

said upper portion of the elastomeric body having a peripheral edge surface which is exposed between peripheral edges of said rear member and said forward plate, continuously from a lower extremity of a first of said side portions of said rear member, at a first side of said bottom recess in said rear member and at a level lower than said upper passage in said elastomeric body and said upper opening in said plate and said screw, upwardly along said first side portion of across the top of said rear member and then downwardly along the second side portion of said member to a lower extremity thereof, at a second side of said bottom recess and at a level lower than said upper passage in said elastomeric body and said upper opening in said plate and said upper screw.

9. A recoil pad as recited in claim 8, in which said rear member is adhesively bonded to said upper portion of said elastomeric material.

10. A recoil pad to be attached to a shoulder gun, comprising:

a forward plate adapted to be secured to the buttstock of the gun;

a body of elastomeric material bonded to the back of said forward plate and resiliently deformable to absorb recoil forces;

a rear member which is formed of a material harder than said elastomeric body and which is embedded in the back of said elastomeric body at the upper end thereof;

said elastomeric body having a lower portion with a rear surface formed of said resiliently deformable elastomeric material and adapted to engage a user's clothing in the shoulder area;

said rear member having a back surface formed on said harder material merging with and forming a smooth upper continuation of said rear surface of said lower portion of the elastomeric body for engaging the user's clothing, with less friction than the elastomeric material, to facilitate sliding of the recoil pad upwardly adjacent the clothing to firing position;

said body having an upper reduced thickness portion formed of said elastomeric material which extends upwardly in front of said rear member at a location between said member and an upper portion of said plate, and which is softer than said rear member and softer than said forward plate to cushion the transmission of recoil forces from said forward plate to said rear member;

said upper portion of said elastomeric body being adhesively bonded at opposite sides to said forward plate and said rear member;

said rear member being free of attachment to said forward plate except through said elastomeric body.

* * * * *